US010715938B2

(12) United States Patent
Kirchhoff et al.

(10) Patent No.: US 10,715,938 B2
(45) Date of Patent: Jul. 14, 2020

(54) RECEIVER / LOUD SPEAKER

(71) Applicant: GN Hearing A/S, Ballerup (DK)

(72) Inventors: Laurids Egedal Kirchhoff, Ballerup (DK); Anders Hjermø Michaelsen, Bagsværd (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 16/218,221

(22) Filed: Dec. 12, 2018

(65) Prior Publication Data

US 2019/0200145 A1 Jun. 27, 2019

(30) Foreign Application Priority Data

Dec. 22, 2017 (EP) ..... 17210378

(51) Int. Cl.

| | |
|---|---|
| ***H04R 25/00*** | (2006.01) |
| ***H01R 13/62*** | (2006.01) |
| ***H04R 1/10*** | (2006.01) |
| ***H01R 13/639*** | (2006.01) |

(52) U.S. Cl.

CPC ..... *H04R 25/60* (2013.01); *H01R 13/62* (2013.01); *H04R 1/1016* (2013.01); *H04R 25/556* (2013.01); *H04R 25/65* (2013.01); *H01R 13/639* (2013.01); *H04R 2225/021* (2013.01); *H04R 2225/0213* (2019.05)

(58) Field of Classification Search

CPC ..... H04R 25/60; H04R 1/1016; H04R 25/65; H04R 2225/0213; H04R 2225/021; H01R 13/62

USPC ..... 381/322

See application file for complete search history.

(56) References Cited

U.S. PATENT DOCUMENTS

| | | | | |
|---|---|---|---|---|
| 9,295,848 | B2 * | 3/2016 | Meskens | A61N 1/37229 |
| 2004/0044389 | A1 * | 3/2004 | Crawford | H04R 25/606 607/116 |
| 2009/0074218 | A1 * | 3/2009 | Higgins | H01R 13/2414 381/323 |
| 2013/0004005 | A1 | 1/2013 | Barth et al. | |
| 2014/0119586 | A1 * | 5/2014 | Mortensen | H04R 25/656 381/330 |
| 2014/0205120 | A1 | 7/2014 | Barth et al. | |
| 2017/0013374 | A1 * | 1/2017 | Larsen | H04R 25/604 |

FOREIGN PATENT DOCUMENTS

WO WO 2012/149963 A1 11/2012

OTHER PUBLICATIONS

Extended European Search Report dated May 22, 2018 for related EP Application No. 17210378.0.

* cited by examiner

*Primary Examiner* — Sean H Nguyen

(74) *Attorney, Agent, or Firm* — Vista IP Law Group, LLP

(57) ABSTRACT

A hearing aid includes: a hearing aid housing with a connector socket; and an earpiece connector with a connector plug; wherein the connector plug of the earpiece connector is configured to releasably couple to the connector socket of the hearing aid housing for connecting the earpiece connector to the hearing aid housing; and wherein the connector plug of the earpiece connector comprises a connector plug body having a deadbolt movably arranged in the connector plug body.

30 Claims, 3 Drawing Sheets

RECEIVER / LOUD SPEAKER

RELATED APPLICATION DATA

This application claims priority to, and the benefit of, European Patent Application No. 17210378.0 filed on Dec. 22, 2017. The entire disclosure of the above application is expressly incorporated by reference herein.

FIELD

The present disclosure relates to hearing aids, and more specifically to hearing aids comprising a hearing aid housing and a connector socket arranged in the hearing aid housing, and an earpiece connector with a connector plug, and where the connector socket and the connector plug are configured such that the connector plug is releasably attached in the connector socket for connecting the connector to the hearing aid housing

DESCRIPTION OF RELATED ART

Hearing aids of the above mentioned kind are known in a lot of different embodiments, where the purpose of having the hearing aid housing and the connector as separate units that may be releasably interconnected, is to ensure that the user can exchange parts without necessarily having to exchange the complete hearing aid.

This is especially important in relation to hearing aids of the BTE kind where the hearing aid housing is to be placed "Behind The Ear" and where the connector is connection the hearing aid housing and an ear plug, such as an ear plug comprising a receiver of the RIE kind that can be arranged "In The Ear".

In this relation there is an ongoing re-search and development with respect to provide RIE hearing aids being easy and cost efficient to maintain in the best possible condition in order to keep optimal sound quality and performance of the hearing aid.

SUMMARY

The purpose of the present disclosure is therefore to provide a hearing aid providing that more maintenance of the hearing aid can be done, e.g. by the user without dedicated tools and by using only few replacement parts especially for exchanging the connector with e.g. a worn out receiver.

This is obtained with the hearing aid mentioned in the introduction and wherein the connector plug comprises a connector plug body having a separate deadbolt movably arranged in the connector plug body.

In a preferred embodiment the connector plug has a front end and a oppositely arranged rear end and a free surface extending between the front end and the rear and facing away from the hearing aid housing when the connector plug is attached in the connector socket, and wherein the earpiece connector extends from the rear end of the connector plug In this relation the connector socket may preferably comprise a rear undercut arranged outside the rear end of the connector plug when it is attached in the connector socket, and the separate deadbolt may have one or more projections arranged such that it can be moved in the connector plug body between a retracted position where the one or more projections are retracted into the connector plug body and an extended position where the one or more projections extends from the rear end of the connector plug body and into engagement with the rear undercut in the connector socket.

The connector plug may further comprise a spring element urging the deadbolt to be moved to its extended position.

In a further preferred embodiment the distal end of the one or more projections has sloping surfaces arranged such that the one or more projections can snap into and/or out of engagement with the rear undercut.

Furthermore the connector plug may advantageously have a front extension projecting outwardly from the front end of the connector plug and the connector socket may have a front undercut arranged such that the front extension engages with the front undercut when the connector plug is attached in the connector socket.

The separate deadbolt may preferably be arranged in a slot formed in the connector plug body at a distance below the free surface and being configured so that the deadbolt can slide between its extended position relatively far away from the front end of the connector plug, and its retracted position closest to the front end of the connector plug.

In this relation the separate deadbolt may advantageously comprise a spring, such as a leaf spring, being arranged for urging the deadbolt to slide to its extended position.

The deadbolt may further comprise a release knob extending through a knob channel in the connector plug body and a distance above the free surface, and where the knob channel is configured such that it allows that a user, just by pushing the release knob in a direction along the free surface, can slide the deadbolt in a direction against the force of the spring and into its retracted position, where the connection plug is released from engagement with the hearing aid housing.

The embodiments described herein are useful for various kinds of hearing aids, such as hearing aids where the connector is a simple sound tube connecting the hearing aid housing with an ear plug, but in the preferred embodiment the hearing aid housing is adapted for being carried behind the ear "BTE" of a hearing aid user, and the connector socket is connected to, or configured for being connected to a receiver adapted for being arranged in the ear "RIE" of the hearing aid user. In this case the connector comprises the necessary electrical wiring for connecting the receiver in the ear of the user, with the electrical components arranged in the hearing aid housing, and the connector plug body as well as the connector socket comprises the necessary electrical contacts adapted for that purpose.

BRIEF DESCRIPTION OF THE DRAWINGS

In the following, the embodiments will be described in greater detail with reference to embodiments shown by the enclosed figures. It should be emphasized that the embodiments shown are used for example purposes only and should not be used to limit the scope of the claimed invention.

DETAILED DESCRIPTION OF THE EMBODIMENTS

Figure 1:
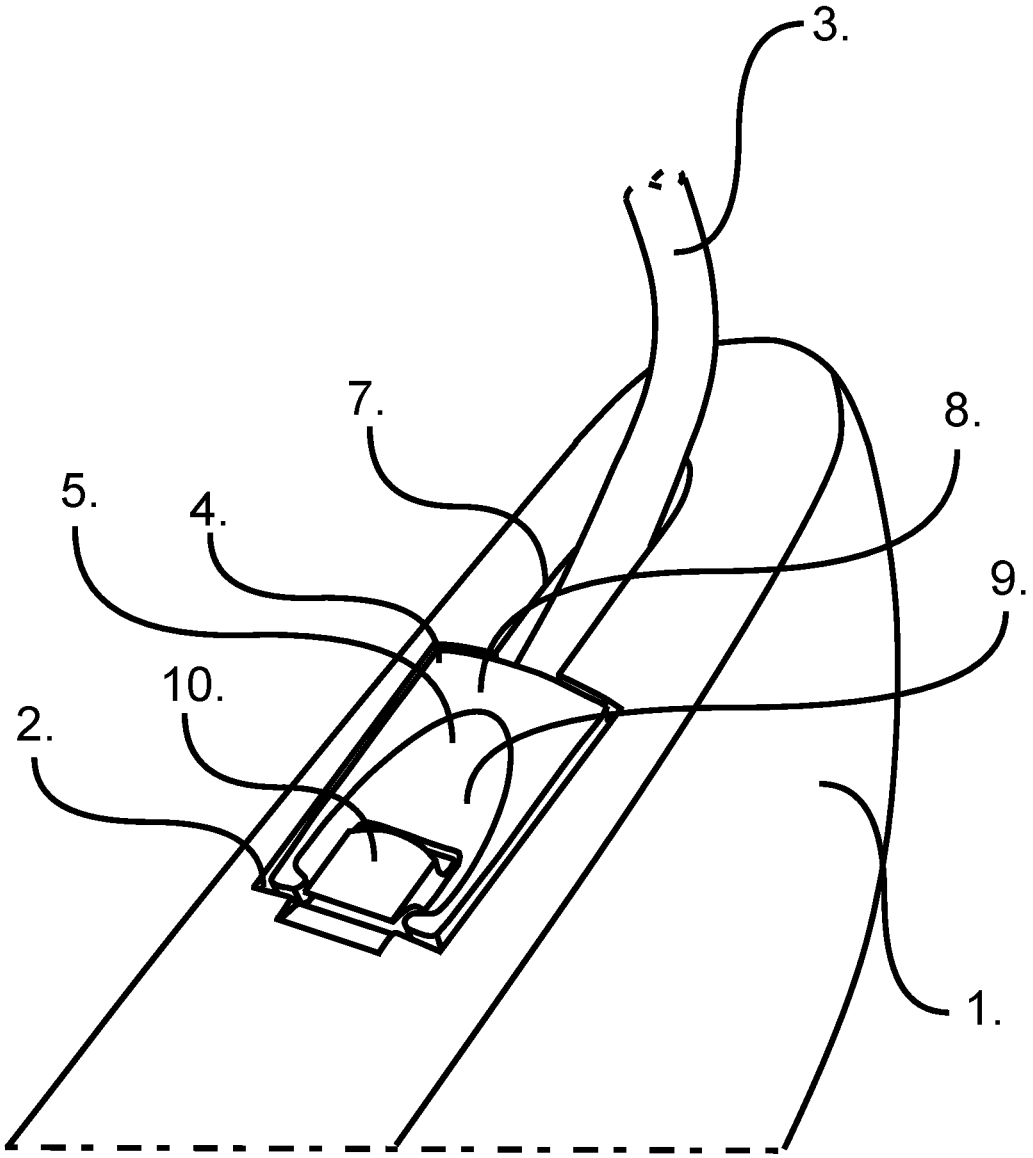
FIG. 1: Is a perspective drawing showing a part of a hearing aid according to some embodiments.

Various embodiments are described hereinafter with reference to the figures. It should be noted that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

Figure 2:
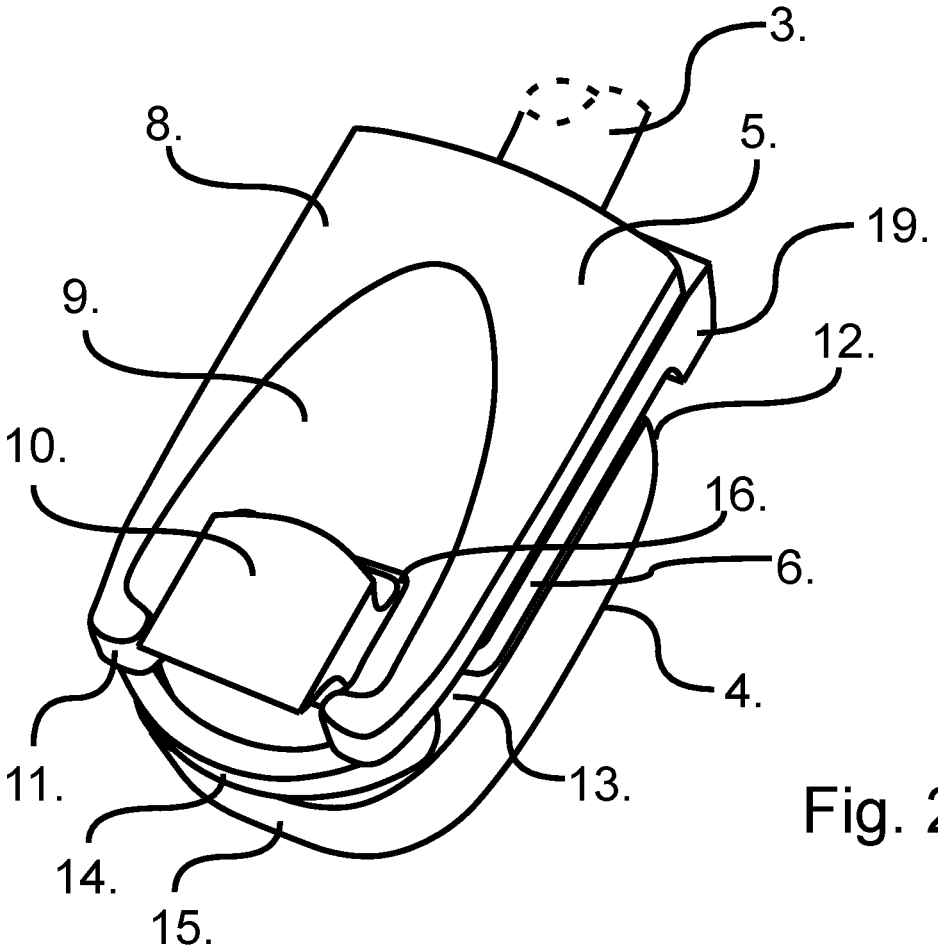
FIG. 2 and FIG. 3: Are different perspectives of the connector as shown on FIG. 1, and with a connector plug according to some embodiments.
Figure 3:
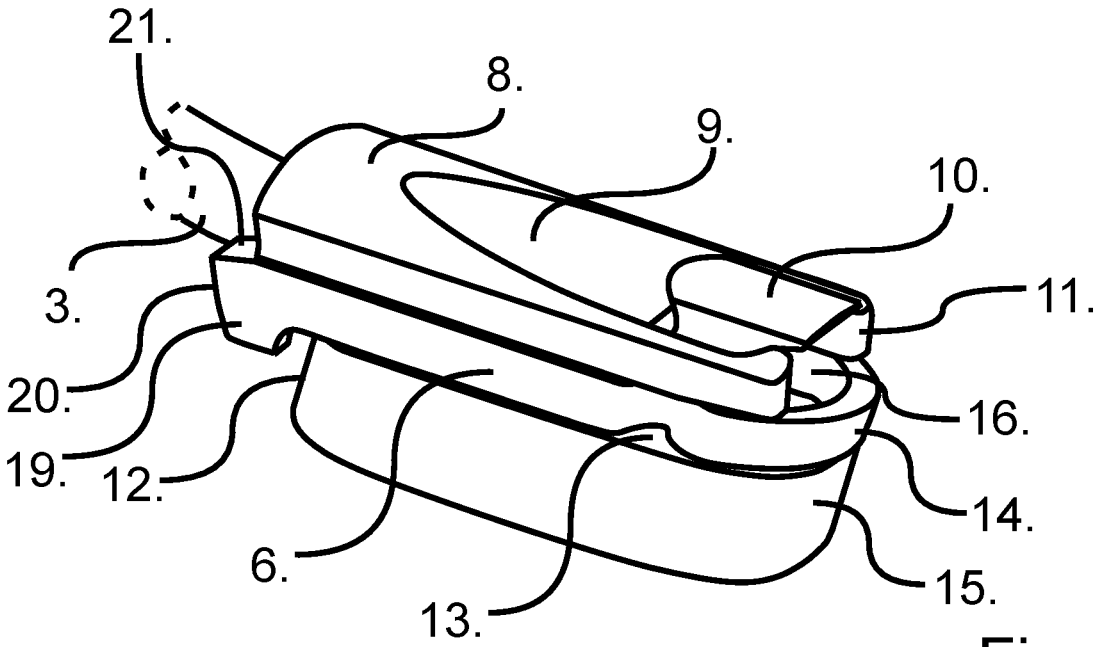

FIGS. 1, 2 and 3 are all perspective drawings showing parts of a hearing aid according to some embodiments. In this embodiment the hearing aid is of the BTE-RIE type, where the hearing aid comprises two separate units, namely an ear plug with at least a receiver to be arranged in the ear of the user, and a hearing aid housing comprising most of the remaining electronics, such as a microphone, a battery and a processing unit, that are necessary for the functionality of the hearing aid. In this relation the connector comprises a set of electrical conductors/wiring adapted for electrical connection between the electronics, such as the receiver in the ear plug, and the remaining electronics in the hearing aid housing. The principle of the embodiments, however, will be applicable to any such hearing aid, and the skilled person would easily be able to suggest many different arrangements of the electronics of the hearing aid. Furthermore the embodiments described herein may also be applicable to hearing aids where all the necessary electronics, or at least the receiver, is arranged in the hearing aid housing, and in such embodiments the connector may comprise a sound tube leading sound to the ear plug from the receiver arranged in the hearing aid housing.

FIG. 1 shows an assembled hearing aid according to some embodiments with the hearing aid housing 1 having an earpiece connector 3 having an ear plug with a receiver arranged at it free end (not shown) and being connected to the hearing aid housing 1 via a connector plug 4 arranged in the connector socket 2. The earpiece connector 3 extends from the connector plug body 5 through a stress relieving channel 7. The connector plug 4 has an upper free surface 8 being flush with the outer surface of the hearing aid housing 1 and has a convex surface area 9 allowing a user to release the connector plug 4 from the connector socket in the hearing aid housing 1 just by sliding e.g. a nail along the convex surface area 9 and against the release knob 10 having an upper surface being flush with the upper free surface 8 of the connector plug 4. The necessity of using a dedicated tool for releasing the connector plug body 5 from the connector socket in the hearing aid housing is thereby avoided.

FIGS. 2 and 3 shows the connector plug 4 as shown in FIG. 1 but in more detail. According to this embodiment the connector plug 4 has a front end 11 and a rear end 12 from which the earpiece connector 3 extends. A deadbolt 6 is slidably arranged in the slot 13 arranged between the front end 11 and the rear end 12 of the connector plug 4, and the deadbolt has a release knob 10 that extends out from the free surface 8 of the connector plug 4 so that it is possible for a user to slide the release knob 10 in the knob channel 16 and there slide the deadbolt 6 in the slot 13.

Figure 4:
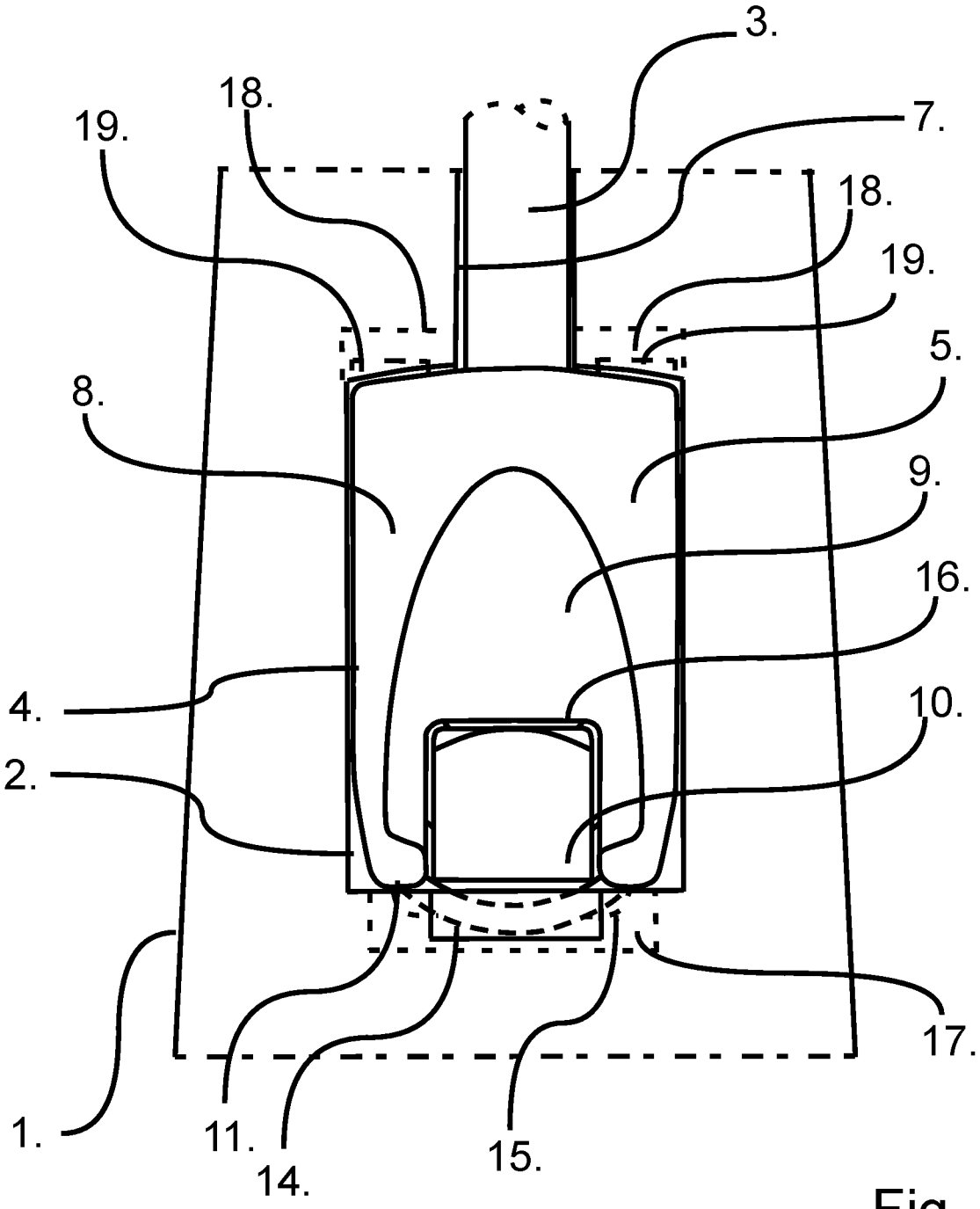
FIG. 4: Is a principle drawing showing a cross section of an alternative embodiment of a hearing aid according to some embodiments.

In this embodiment the deadbolt is made from a thermoplastic material by injection molding and has projections extending out from the rear end 12 of the connector plug 4 and at the opposite end it has integrally molded leaf spring 14 arranged such that when the leaf spring 14 is compressed then it urges the deadbolt 6 to slide in the slot 13 to the position shown in FIGS. 2 and 3, where its projections 19 extends out from the rear end 12 of the connector plug 4 and engages with undercuts 18 arranged in the hearing aid housing 1 as shown in FIG. 4.

The front end of the connector plug is provided with a fixed extension 15 arranged at the front end 11 of the connector plug 4 where it engages with the undercut 17 arranged in the hearing aid housing 1 as shown in FIG. 4. Due to the fact that the deadbolt has lower and upper sloping surfaces 20, 21 arranged at the projections 19 then it is easy for the user to attach the connector plug 4 in the hearing aid housing just by first positioning the fixed extension 15 on the front end 11 of the connector plug 4 in the undercut 17 in the hearing aid housing, and thereafter pressing the connector plug 4 into the connector socket 2 in the hearing aid housing so that the lower sloping surface 20 urges the deadbolt 6 to slide against the force of the leaf spring 14 and when the projection 19 of the deadbolt 6 aligns with the undercuts 18 in the hearing aid housing then the leaf spring urges the deadbolt 6 to slide back so that the projections 19 engages with the undercuts 18.

In this position the connector plug is firmly attached to the connector socket in the hearing aid housing, and any electrical contacts and/or sound tubes (not shown) are aligned to ensure proper functionality of the hearing aid. In this position, however, if the earpiece connector 3 is exposed to a significant pulling force, then the design of the upper sloping surface 21 is made so that the projections 19 of the deadbolt 6 automatically disengages from the undercuts 18 in the hearing aid housing 1 before the earpiece connector is pulled out of the connector plug 4.

Although some embodiments have been described and shown in detail, the claimed invention is not restricted to them, but may also be embodied in other ways within the scope of the subject matter defined in the following claims. In particular, it is to be understood that other embodiments may be utilized and structural and functional modifications may be made without departing from the scope of the present invention. As mentioned above it will e.g. be apparent to the skilled person that one or more embodiments described herein may also be used in relation to hearing aids of another type than the above mentioned BTE-RIE type, even though the advantages are especially relevant to the BTE-RIE type hearing aids.

In device claims enumerating several features, several of these features can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

a hearing aid housing with a connector socket; and an earpiece connector with a connector plug;

wherein the connector plug of the earpiece connector is configured to releasably couple to the connector socket of the hearing aid housing for connecting the earpiece connector to the hearing aid housing; and wherein the connector plug of the earpiece connector comprises a connector plug body and a deadbolt moveable relative to the connector plug body; and wherein the deadbolt is mechanically coupled to the connector plug body regardless of whether the connector plug is coupled to, or is released from, the connector socket.

2. The hearing aid according to claim 1, wherein the deadbolt is spring activated.

3. The hearing aid according to claim 1, wherein the connector plug comprises a spring configured to provide a spring force.

4. The hearing aid according to claim 1, wherein the connector plug has a front end, an opposite rear end, and a free surface extending between the front end and the rear end, the free surface facing away from the hearing aid housing when the connector plug is coupled to the connector socket.

5. The hearing aid according to claim 1, wherein the connector socket comprises a rear undercut.

6. The hearing aid according to claim 5, wherein the connector plug has a front extension projecting outwardly from a front end of the connector plug, wherein the connector socket has a front undercut, and wherein the front extension of the connector plug is configured to engage with the front undercut of the connector socket when the connector plug is coupled to the connector socket.

7. The hearing aid according to claim 1, wherein the deadbolt is in a slot of the connector plug body, and wherein the deadbolt is moveable between an extended position that is away from a front end of the connector plug, and a retracted position.

8. The hearing aid according to claim 1, wherein the hearing aid housing is configured for placement behind an ear of a user of the hearing aid.

9. The hearing aid according to claim 1, wherein the connector plug of the earpiece connector is connected to, or is configured to connect to, a receiver that is configured for being placed in an ear of a user of the hearing aid.

10. The hearing aid according to claim 1, wherein the deadbolt comprises a deadbolt end with a slanted surface.

11. The hearing aid according to claim 1, further comprising a tube or a cable extending from the earpiece connector, wherein the hearing aid housing comprises a channel for accommodating a part of the tube or the cable.

12. A hearing aid comprising:

a hearing aid housing with a connector socket; and an earpiece connector with a connector plug;

wherein the connector plug of the earpiece connector is configured to releasably couple to the connector socket of the hearing aid housing for connecting the earpiece connector to the hearing aid housing; and wherein the connector plug of the earpiece connector comprises a connector plug body and a deadbolt moveable relative to the connector plug body;

wherein the connector plug comprises a spring; and wherein the deadbolt comprises a knob that is moveable in a direction against a spring force of the spring.

13. The hearing aid according to claim 12, wherein the knob extends through a knob channel in the connector plug body, and wherein the knob is operable by a user to move the deadbolt.

14. The hearing aid according to claim 12, wherein the hearing aid housing is configured for placement behind an ear of a user of the hearing aid.

15. The hearing aid according to claim 12, wherein the connector plug of the earpiece connector is connected to, or is configured to connect to, a receiver that is configured for being placed in an ear of a user of the hearing aid.

16. The hearing aid according to claim 12, wherein the deadbolt comprises a deadbolt end with a slanted surface.

17. The hearing aid according to claim 12, further comprising a tube or a cable extending from the earpiece connector, wherein the hearing aid housing comprises a channel for accommodating a part of the tube or the cable.

18. A hearing aid comprising:

a hearing aid housing with a connector socket; and an earpiece connector with a connector plug;

wherein the connector plug of the earpiece connector is configured to releasably couple to the connector socket of the hearing aid housing for connecting the earpiece connector to the hearing aid housing; and wherein the connector plug of the earpiece connector comprises a connector plug body and a deadbolt moveable relative to the connector plug body;

wherein the deadbolt has one or more projections, and wherein the deadbolt is moveable relative to the connector plug body between a retracted position that allows the one or more projections to be placed into the connector socket, and an extended position where at least a part of the one or more projections is outside the connector plug body for engagement with the connector socket.

19. The hearing aid according to claim 18, wherein the connector plug further comprises a spring element urging the deadbolt towards the extended position.

20. The hearing aid according to claim 18, wherein a distal end of one of the one or more projections has a sloping surface.

21. The hearing aid according to claim 18, wherein the one or more projections are configured to snap into and/or out of engagement with a rear undercut of the connector socket.

22. The hearing aid according to claim 18, wherein the hearing aid housing is configured for placement behind an ear of a user of the hearing aid.

23. The hearing aid according to claim 18, wherein the connector plug of the earpiece connector is connected to, or is configured to connect to, a receiver that is configured for being placed in an ear of a user of the hearing aid.

24. The hearing aid according to claim 18, wherein the deadbolt comprises a deadbolt end with a slanted surface.

25. The hearing aid according to claim 18, further comprising a tube or a cable extending from the earpiece connector, wherein the hearing aid housing comprises a channel for accommodating a part of the tube or the cable.

26. A hearing aid comprising:

a hearing aid housing with a connector socket; and an earpiece connector with a connector plug;

wherein the connector plug of the earpiece connector is configured to releasably couple to the connector socket of the hearing aid housing for connecting the earpiece connector to the hearing aid housing; and wherein the connector plug of the earpiece connector comprises a connector plug body and a deadbolt moveable relative to the connector plug body;

wherein the connector socket comprises a rear undercut; and wherein the deadbolt has one or more projections, and wherein the deadbolt is moveable relative to the connector plug body between a retracted position that allows the one or more projections to be placed into the connector socket, and an extended position where at least a part of the one or more projections is in engagement with the rear undercut of the connector socket.

27. The hearing aid according to claim 26, wherein the hearing aid housing is configured for placement behind an ear of a user of the hearing aid.

28. The hearing aid according to claim 26, wherein the connector plug of the earpiece connector is connected to, or is configured to connect to, a receiver that is configured for being placed in an ear of a user of the hearing aid.

29. The hearing aid according to claim 26, wherein the deadbolt comprises a deadbolt end with a slanted surface.

30. The hearing aid according to claim 26, further comprising a tube or a cable extending from the earpiece connector, wherein the hearing aid housing comprises a channel for accommodating a part of the tube or the cable.

* * * * *